US008568222B2

(12) United States Patent
Gagner et al.

(10) Patent No.: US 8,568,222 B2
(45) Date of Patent: Oct. 29, 2013

(54) GAMING SYSTEM HAVING CHALLENGE GAMEPLAY

(75) Inventors: Mark B. Gagner, West Chicago, IL (US); Shridhar P. Joshi, Naperville, IL (US); Robert Siemasko, Lake Forest, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 373 days.

(21) Appl. No.: 12/738,595

(22) PCT Filed: Sep. 25, 2008

(86) PCT No.: PCT/US2008/011091

§ 371 (c)(1),
(2), (4) Date: Apr. 16, 2010

(87) PCT Pub. No.: WO2009/051637

PCT Pub. Date: Apr. 23, 2009

(65) Prior Publication Data

US 2010/0216536 A1 Aug. 26, 2010

Related U.S. Application Data

(60) Provisional application No. 60/999,268, filed on Oct. 17, 2007, provisional application No. 61/123,692, filed on Apr. 10, 2008.

(51) Int. Cl.
*G07F 17/32* (2006.01)

(52) U.S. Cl.
USPC ..... 463/25; 463/16; 463/20; 463/29

(58) Field of Classification Search
USPC ..... 463/16–20, 25–29
See application file for complete search history.

(56) References Cited

U.S. PATENT DOCUMENTS

| | | | | |
|---|---|---|---|---|
| 5,470,080 | A * | 11/1995 | Naka et al. | 463/33 |
| 6,210,275 | B1 * | 4/2001 | Olsen | 463/16 |
| 6,287,202 | B1 * | 9/2001 | Pascal et al. | 463/42 |
| 6,458,060 | B1 * | 10/2002 | Watterson et al. | 482/54 |
| 6,652,378 | B2 * | 11/2003 | Cannon et al. | 463/20 |
| 6,902,478 | B2 | 6/2005 | McClintic | |
| 6,929,546 | B2 * | 8/2005 | Moore et al. | 463/30 |

(Continued)

OTHER PUBLICATIONS

International Search Report for PCT/US2008/011091, dated Nov. 26, 2008 (1 page).

(Continued)

*Primary Examiner* — Omkar Deodhar
(74) *Attorney, Agent, or Firm* — Nixon Peabody LLP

(57) ABSTRACT

A gaming system comprises a wager input device for receiving wagers and at least one display for displaying a challenge-play game. The system further comprises a controller operative to detect an issuance of a challenge by a first player and an acceptance of the challenge by a second player to participate in the challenge-play game. The controller detects receipt of a wager input from at least one of the first and second players, and in response thereto, causes the at least one display to display the challenge-play game. The controller determines at least one outcome of the challenge-play game, and based upon the at least one outcome, adjusts the positions of one or both of the first and second players in a standings chart.

20 Claims, 7 Drawing Sheets

(56) References Cited

U.S. PATENT DOCUMENTS

| | | | | |
|---|---|---|---|---|
| 2003/0069072 | A1* | 4/2003 | Miura | 463/42 |
| 2003/0114219 | A1* | 6/2003 | McClintic | 463/25 |
| 2006/0258463 | A1* | 11/2006 | Cugno et al. | 463/42 |
| 2007/0293293 | A1* | 12/2007 | Baerlocher et al. | 463/16 |
| 2008/0108404 | A1* | 5/2008 | Iddings et al. | 463/16 |

OTHER PUBLICATIONS

Written Opinion for PCT/US2008/011091, dated Nov. 26, 2008 (4 pages).
International Preliminary Report on Patentability for PCT/US2008/011091, dated Dec. 22, 2009 (12 pages).

* cited by examiner

GAMING SYSTEM HAVING CHALLENGE GAMEPLAY

CROSS REFERENCE TO RELATED APPLICATIONS

This application is a U.S. national stage filing of International Application No. PCT/2008/011091, filed Sep. 25, 2008 claiming priority from both U.S. Provisional Application No. 60/999,268, filed Oct. 17, 2007, and from U.S. Provisional Application No. 61/123,692, filed Apr. 10, 2008, which are both incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having challenge game play.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Other gaming systems have employed various types of group and community play. The present invention is directed toward a gaming system having challenge game play.

SUMMARY OF THE INVENTION

According to one aspect of the present invention, a gaming system comprises a wager input device for receiving wagers and at least one display for displaying a challenge-play game. The system further comprises a controller operative to detect an issuance of a challenge by a first player and an acceptance of the challenge by a second player to participate in the challenge-play game. The controller detects receipt of a wager input from at least one of the first and second players, and in response thereto, causes the at least one display to display the challenge-play game. The controller determines at least one outcome of the challenge-play game, and based upon the at least one outcome, adjusts the positions of one or both of the first and second players in a standings chart.

According to another aspect of the invention, a gaming system comprises a first gaming device displaying a first primary wagering game to a first player in response to receiving a first primary wager and a second gaming device displaying a second primary wagering game to a second player in response to receiving a second primary wager. The system further comprises a first input device in communication with the first gaming device for receiving a challenge-play input from the first player, the challenge-play input comprising a locator input for locating a competitor and issuing a challenge-play invitation to the competitor. The system further comprises a second input device in communication with the second gaming device for receiving a response input from the second player, the response input accepting, rejecting, or modifying the challenge-play invitation. The system comprises at least one display for displaying a selected challenge-play game in response to acceptance of the challenge-play invitation by the second player.

According to yet another aspect of the invention, a method of operating a wagering game comprises displaying a first primary wagering game to a first player in response to receipt of a first primary wager and displaying a second primary wagering game to a second player in response to receipt of a second primary wager. The method further comprises detecting issuance of a challenge-play invitation by the first player and an acceptance of the challenge-play invitation by the second player, the challenge-play invitation comprising a selection of a challenge-play game. The method further comprises determining eligibility of the first and second players to participate in the challenge-play game, collecting challenge play funds for funding the challenge-play game, and displaying the challenge-play game.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
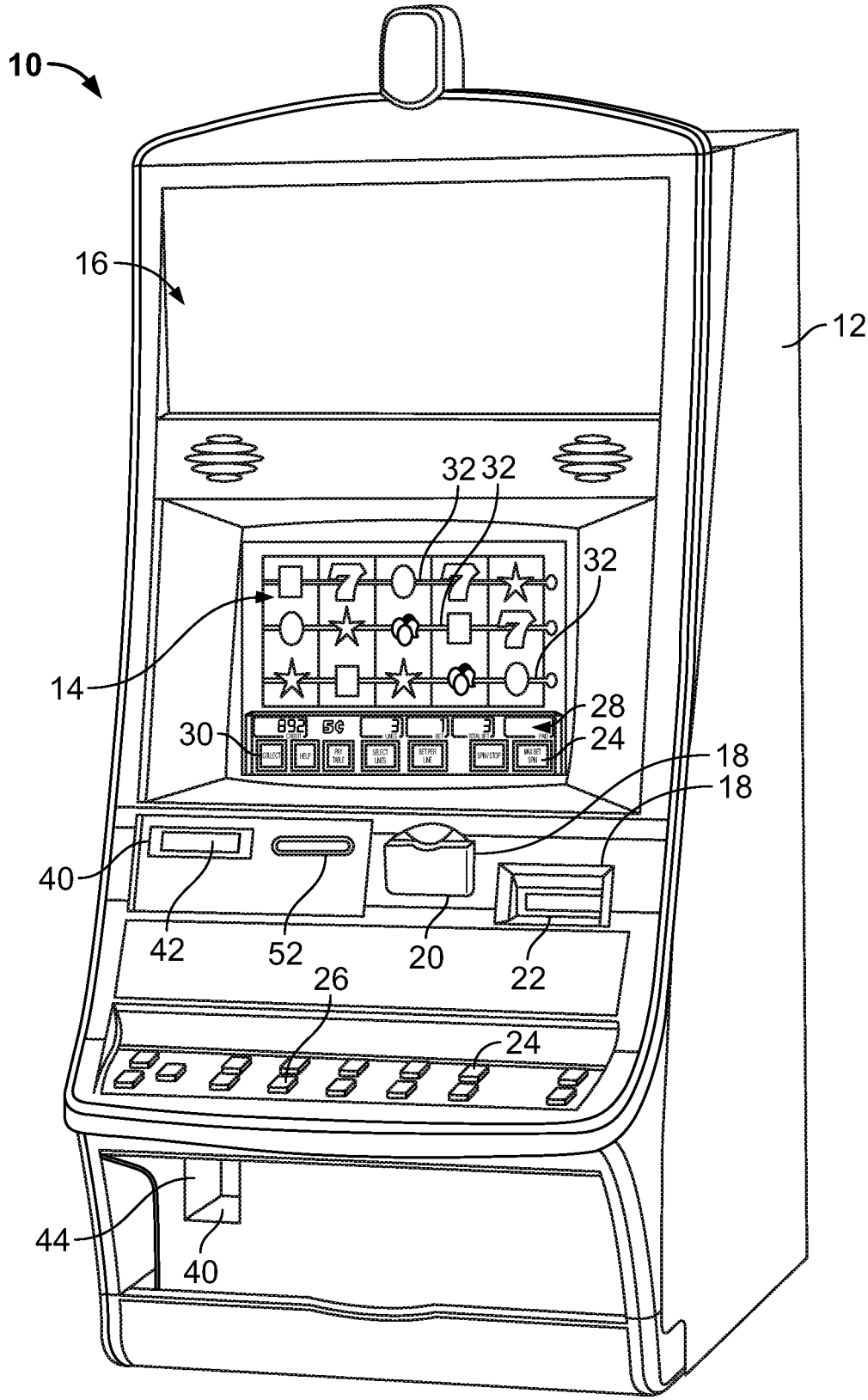
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
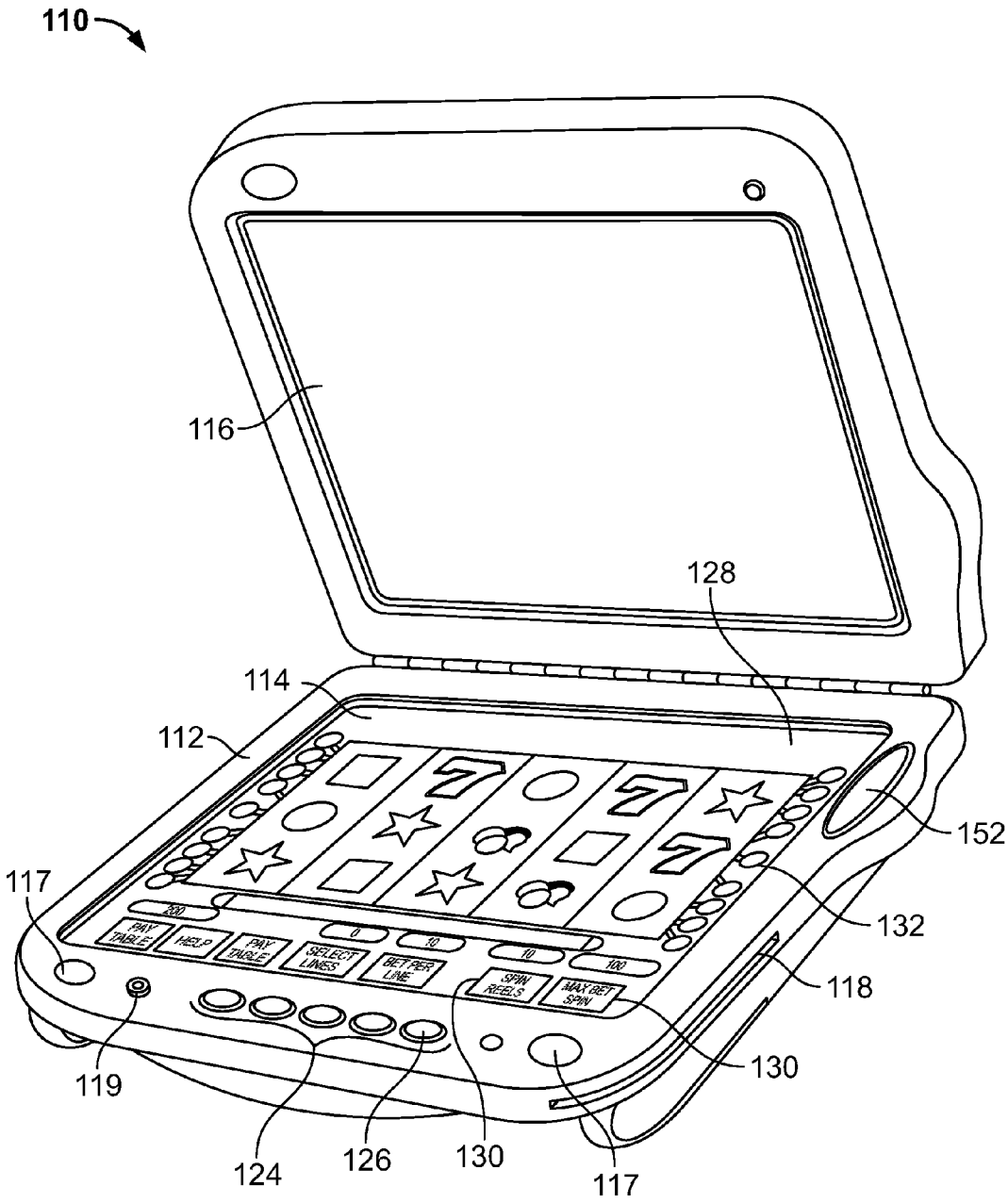
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
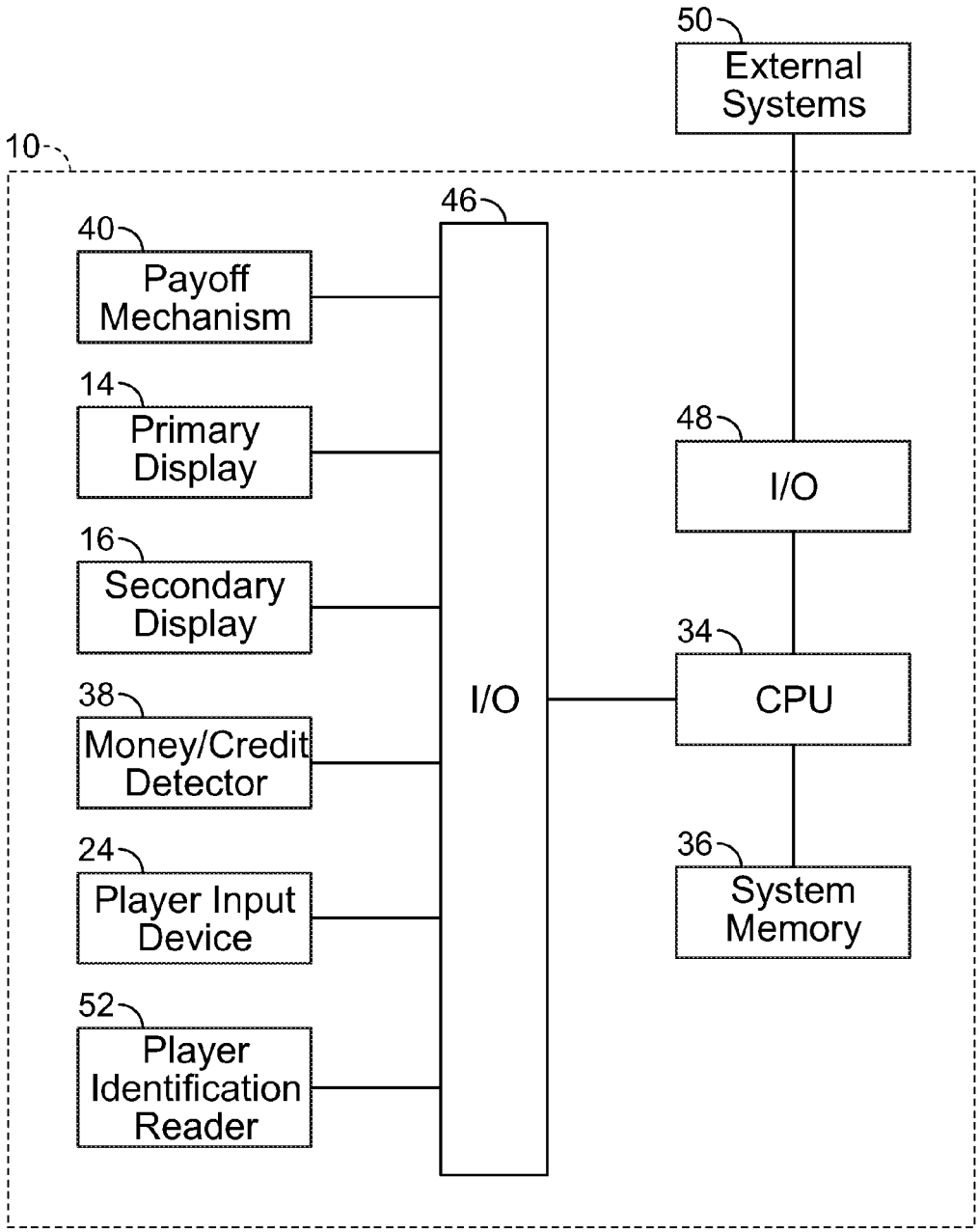
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
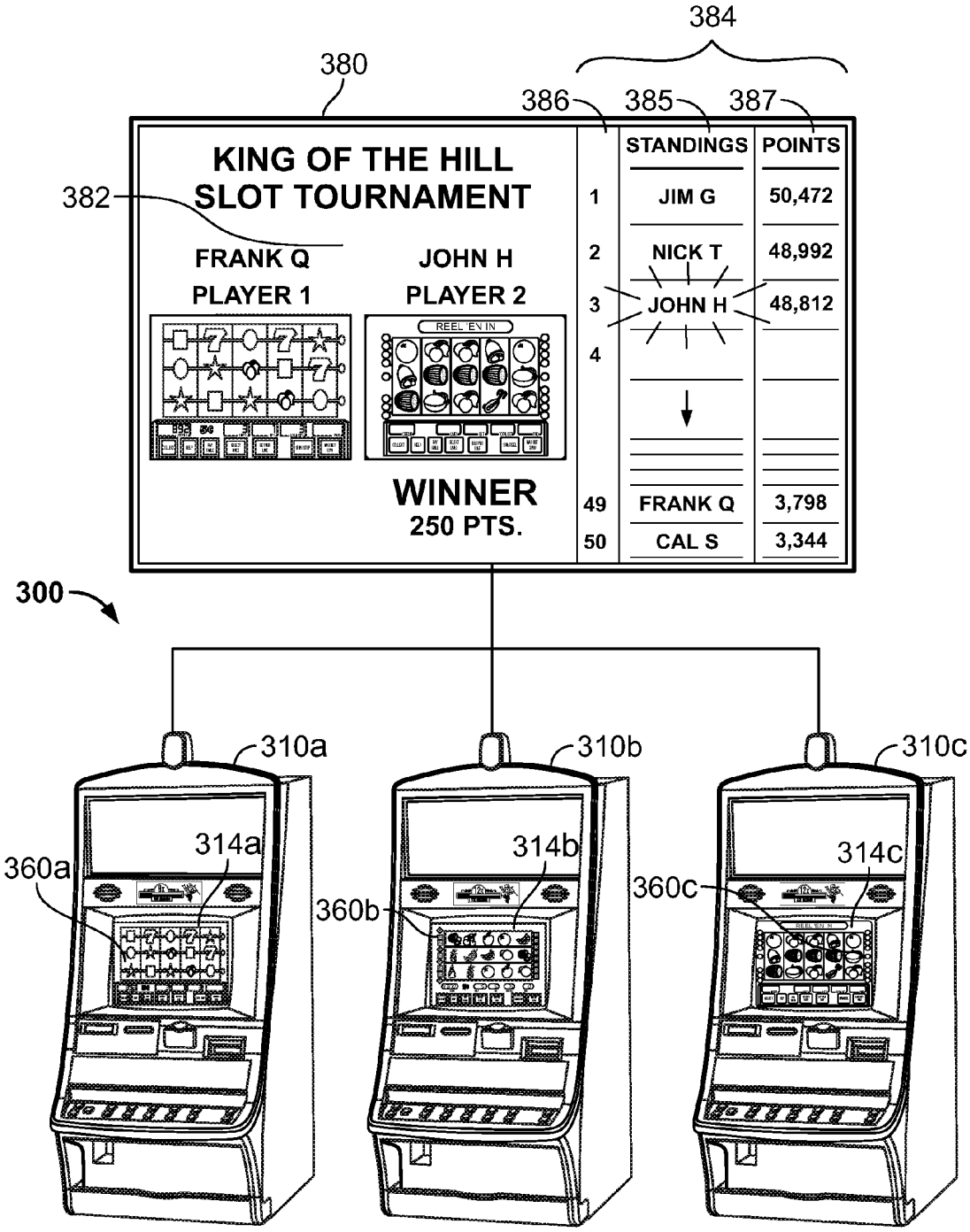
FIG. 3 is a diagram of a gaming system having challenge game play features.

Turning now to FIG. 3, a gaming system 300 is displayed. The gaming system 300 comprises a plurality of gaming devices 310*a,b,c* in communication with at least one community display 380 or overhead display. The gaming devices 310*a,b,c* and the community display 380 may be in communication with and controlled by one or more operator control computers (not shown). The gaming devices 310*a,b,c* can take on various forms, such as the freestanding and handheld gaming devices depicted and described with reference to FIGS. 1*a* and 1*b*. Each of the gaming devices 310*a,b,c* comprises a primary display 314*a,b,c*, which may be any form of display such as those described herein. Each primary display 314*a,b,c* includes display of a primary wagering game 360*a,b,c*, which in this embodiment are slot games as shown in FIG. 3. The slot games 360*a,b,c* includes a plurality of reels which may be either electro-mechanical reels or simulations thereof on the primary display 314*a,b,c*. The reels include a plurality of symbols displayed thereon which vary as the reels are spun and stopped. The symbols may include any variety of graphical symbols, elements, or representations, including symbols which are associated with one or more themes of the gaming machine or system. The symbols may also include a blank symbol, or empty space.

As described herein the symbols landing on the active paylines (the paylines for which a wager has been received) are evaluated for winning combinations. If a winning combination of symbols lands on an active payline a primary award is awarded in accordance with a pay table of the gaming device 310*a,b,c*. The symbols on the reels form an array or matrix of symbols, having a number of rows and columns, which in the embodiment shown is three four rows and five columns. In alternate embodiments, the array may have greater or fewer symbols, and may take on a variety of different forms having greater or fewer rows and/or columns. The array may even comprise other non-rectangular forms or arrangements of symbols.

The community display 380, in an embodiment, is mounted above a bank of gaming device 310*a,b,c* so as to be visible by players positioned at the gaming devices 310*a,b,c*. In other embodiments, the community display 380 may be located in other areas or positions, either inside a casino or operator's establishment, or remote there from. The community display 380 displays a community game 382, which in this embodiment is a competition involving two or more players of the primary wagering games 360*a,b,c* in a challenge play scenario. As shown, the community display 380 depicts a community game 382 which is the "King of the Hill Slot Tournament." A first player (Frank Q) has issued a challenge to a second player (John H) to participate in a head-to-head competition in the community game 382. Because the second player (John H) has accepted the challenge, the community game 382 is displayed and executed. In the embodiment shown, the community game 382 is a slot tournament in which each player is given a predetermined number of spins of a slot game, and the winner is the player who totals the most credits or points during that set of spins. As indicated on the community display 380, upon conclusion of the set of spins for each player, the second player (John H) is declared the winner and is awarded 250 points in the community game 382. The losing player (Frank Q) may be awarded a second prize or consolation prize, or alternatively, may not receive any award at all.

As seen along a right hand side of the community display 380, a standings chart 384 displays the current standings of players who are competing, or in the past have competed in the community game 382. The standings chart 384 lists the players by player identifier 385 (such as their name or player identification number) and further indicates the player's position 386 (1 through 50) and point total 387. The second player (John H) is highlighted on the standings chart 384 as a result of having won the challenge-play game 382 against the first player (Frank Q). The second player's name is highlighted to indicate that he is the winner and also to indicate that he has moved up on the standings chart 384 to third position, with a total of 48,812 points. The losing player (Frank Q) also appears on the standings chart 384 with a point total of 3,798. Thus, the standings chart 384 provides a ladder system in which multiple players' cumulative point totals are kept and updated, and their relative positions are displayed, in response to the results of challenge play events occurring between or among them.

Figure 4:
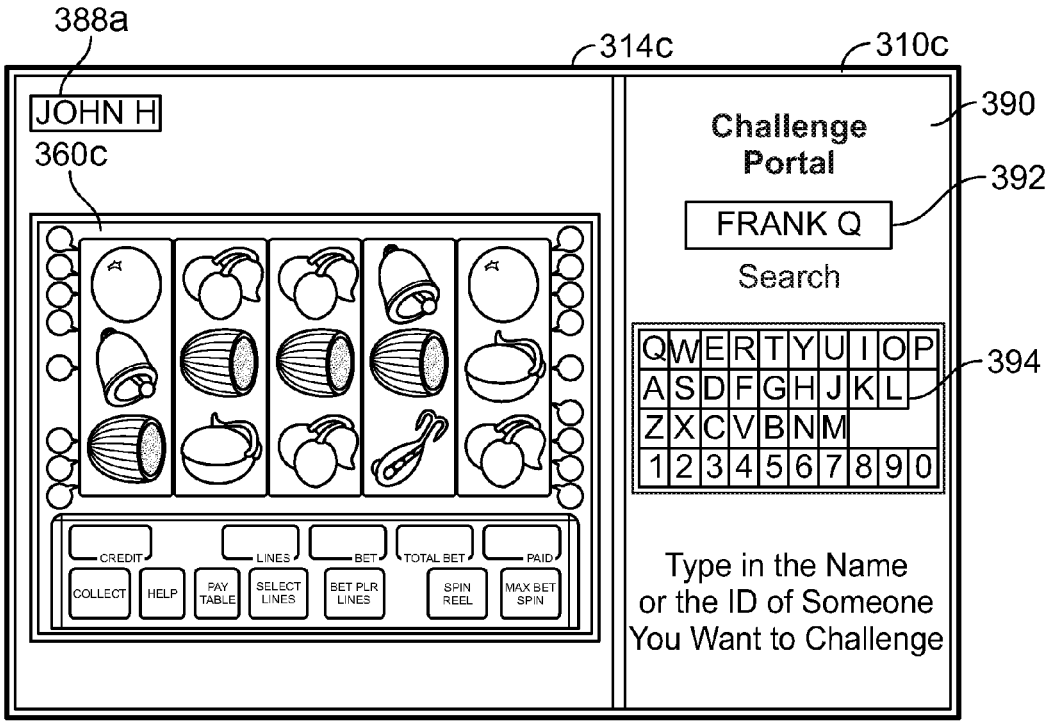
FIG. 4 is a screen shot of a gaming device of a gaming system depicting a first player is initiating a challenge.

Turning to FIG. 4, the primary display 314*c* of one of the gaming devices 310*c* of FIG. 3 is shown, as being played by a first player (John H). The primary display 314*c* displays a primary wagering game 360*c* which is a slot game having a theme and title of "Reel Em In." In the upper left hand corner of the primary display 314*c* is a player label 388*a* indicating that "John H" is the player playing the gaming device 310*c*. The player label 388*a* is associated with and corresponds to a particular player, which is identified to the gaming system 300 and gaming device 310*c* by use of a player identifier, such as a player tracking card, user name and password, biometric identifier, or other identifier as described herein. The player label 388*a* may display a player's name, a player nickname or screen name, a player identification number or alpha-numeric string, a player avatar or icon, or any other identifier which provides a visual indicator of the player playing the primary wagering game 360*c*.

On the right hand side of the primary display 314*c* is a challenge portal 390. The challenge portal 390 comprises an interface through which a player of gaming device 310*c* can search for and locate other players, and issue game play challenges to such players. Thus, on a first screen of the challenge portal 390 shown in FIG. 4, a player can search for another player for the purposes of challenging that player to a game play competition. A search field 392 is displayed as well as one or more input devices 394, which in this embodiment comprises a touch screen keyboard where the player may input search string criteria, which is in turn displayed in the search field 392. In FIG. 4, the first player (John H) has used the input device 394 to input a search for a player named "Frank Q," in accordance with the instructions in the challenge portal 390 which indicated "Type in the Name or the ID of Someone You Want to Challenge." Upon initiating the search using the challenge portal 390, the gaming system 300 searches for and locates the desired player (Frank Q) to see if he or she is available and/or eligible to participate in a challenge-play game. For example, if the desired player (Frank Q) is playing an eligible gaming device 310, or is logged in and locatable by his player identifier, then he may be located and declared "available" for challenge play.

Figure 5:
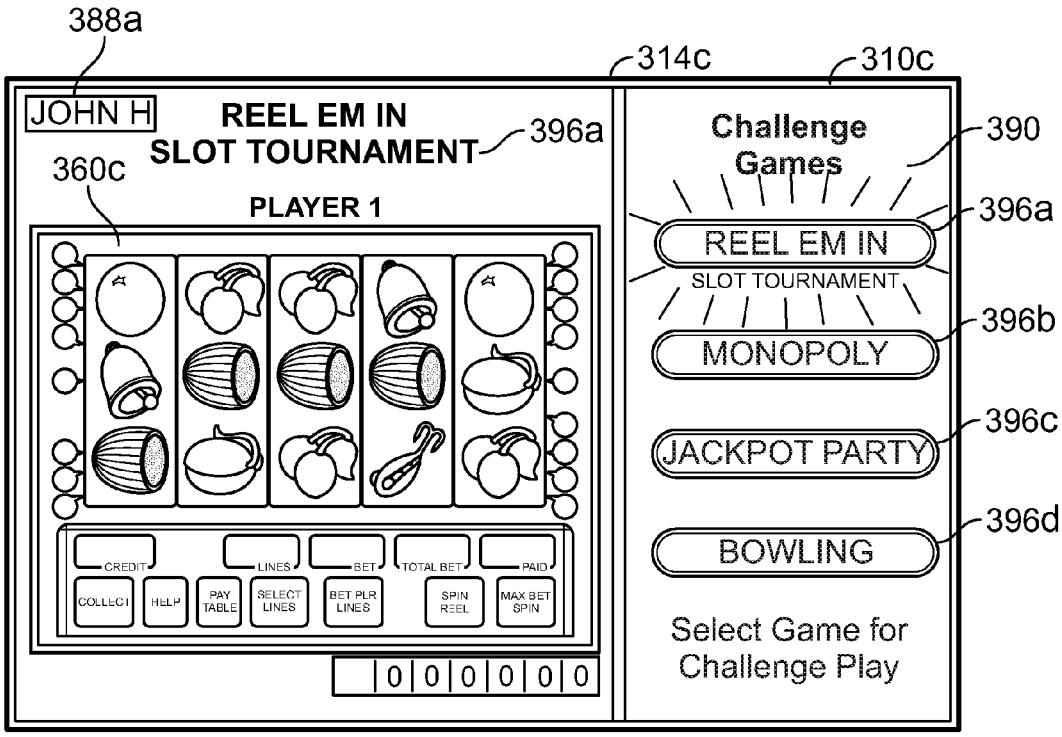
FIG. 5 is a screen shot of the gaming system of FIG. 4, depicting the first player is selecting a game for the issued challenge.

Turning to FIG. 5, a second screen of the challenge portal 390 presents a plurality of challenge-play games 396*a,b,c,d* which are available to be selected by the player issuing the challenge. Thus, the issuing player (John H), selects the touch key button corresponding with "Reel Em In Slot Tournament" game 396*a*, in accordance with the instructions on the primary display 314 which indicate to "Select Game for Challenge Play." Once selected, the challenge-play game 396*a* becomes activated. Thus, the primary display 314*c* of the first player's gaming device 310*c* now indicates the label "Reel Em In Slot Tournament" above the display of the primary wagering game 360*c*. A point total is shown below the primary wagering game 360*c*, showing the first player's (John H) accumulated points during challenge-play game 396*a*. As seen in FIG. 5, prior to the commencement of the challenge-play game 396*a*, the point total is zero.

Figure 6:
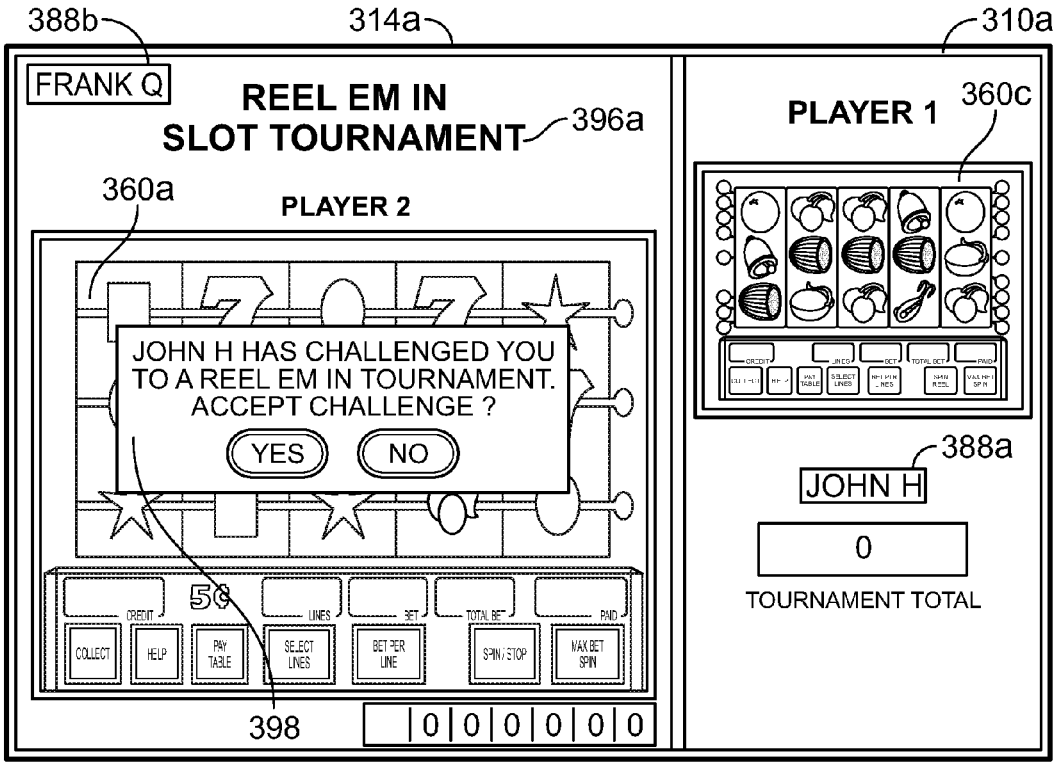
FIG. 6 is a screen shot of the gaming system of FIG. 4, depicting a second player receiving the issued challenge.

Turning to FIG. 6, the primary display 314*a* of a second player's gaming device 310*a* of the system 300 is displayed. The primary display 314*a* depicts a primary wagering game 360*a*, which in this embodiment is also a slot game having geometric symbols. The second player is identified by a player label 388*b* shown on the upper left hand corner of the display 314*a*. Overlying the primary wagering game 360*a* on the display 314*a* is a pop-up window 398 which communicates challenge information to the second player (Frank Q). Here, the pop-up window 398 informs the second player of the nature of the challenge by indicating "John H has challenged you to a Reel Em In Tournament. Accept Challenge?" As seen in FIG. 6, the pop-up window 398 also prompts the second player (Frank Q) to either accept or reject the challenge by inputting "Yes" or "No" via a touch screen input in the pop-up window 398. Here the second player (Frank Q) has accepted the challenge to engage in the challenge-play game 396*a*, by pressing the "Yes" touch key. As a result, the primary display 314*a* on the second player's (Frank Q) gaming device 310*a* has changed to display a label corresponding to "Reel Em In Slot Tournament" along a top of the display 314*a*. Moreover, along a right hand side of the display 314*a*, the second player (Frank Q) is now able to see the primary wagering game 360*c* of the first player (John H) as well his player identifier 388*a* and tournament point total. Thus, by accepting the challenge and upon commencement of the challenge-play game 396*a*, the display 314*a* is altered to display both the second player's game play in the challenge-play game 396*a* and the first player's game play in the challenge-play game 396*a*. In this way, the second player can monitor his own progress and outcomes, as well as those of the first player who issued the challenge.

Figure 7:
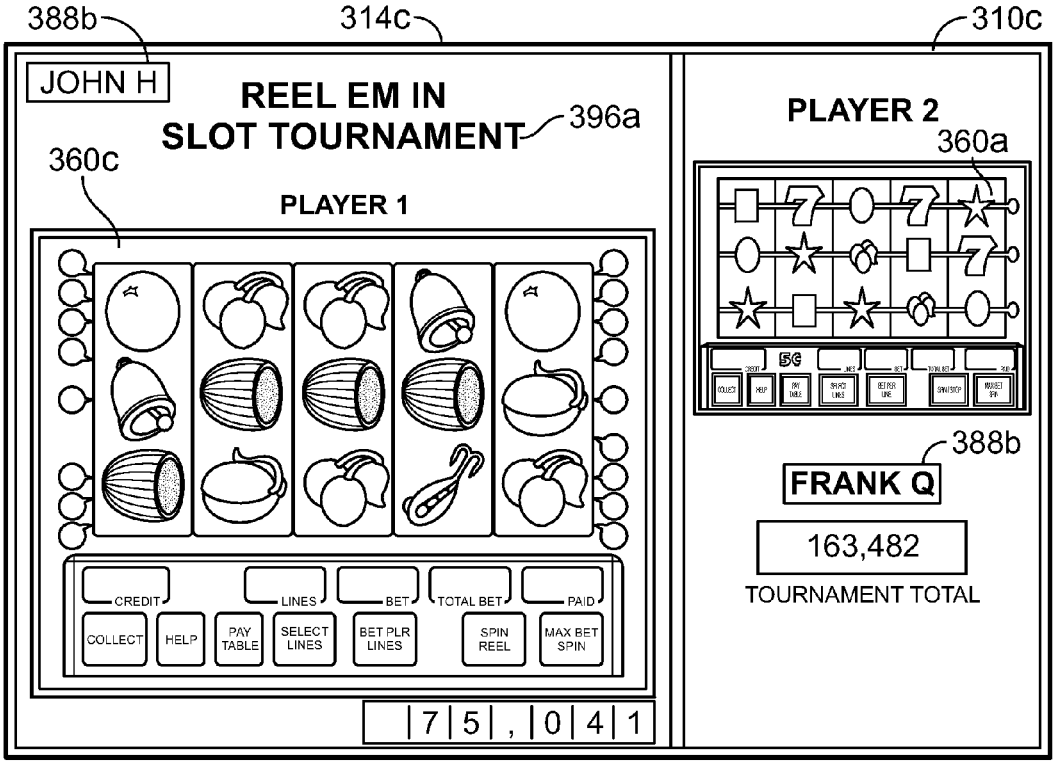
FIG. 7 is a screen shot of a first player's gaming device competing in a challenge-play game.

In FIG. 7, a subsequent view of the primary display 314*c* of the first player's (John H) gaming device 310*c* is shown. The second player (Frank Q) has accepted the challenge issued by the first player (John H). Thus, on the first player's primary display 314*c* (FIG. 7), the right hand portion of the display 314*c* is now dedicated to displaying a view of the primary wagering game 360*a* displayed on the primary display 314*a* of the second player's (Frank Q) gaming device 310*a*. Thus, the first player (John H) can simultaneously view his own primary wagering game 360*c* and his competitor's (Frank Q) primary wagering game 360*a*, as they compete in the challenge-play game 396*c*. As seen in FIG. 7, the first player (John H) plays a primary wagering game 360*c* which is a Reel Em In themed slot game, while the second player (Frank Q) plays a primary wagering game 360*a* which has a different theme (geometric shapes). However, each player individually collects points and credits for winning outcomes in their primary wagering games 360*a,c*. Such point totals are shown below their respective primary wagering games 360*a,c* such that the first player (John H) can monitor his own progress in the challenge-play game 396*a*, as well as the progress of his competitor (John Q). The primary display 314*c* further includes a player label 388*b* which indicates that the right hand side of the screen is dedicated to the second player, by displaying the second player's identification as "Frank Q," as well as that player's tournament total (or total accumulated points in the challenge-play game 396*a*). Because the challenge-play game 396*a* has progressed, each of the player's respective point totals is shown below their primary wagering games 360*a,c*. As seen in FIG. 7, the second player (Frank Q) has won the challenge with a total of 163,482 points.

Figure 8:
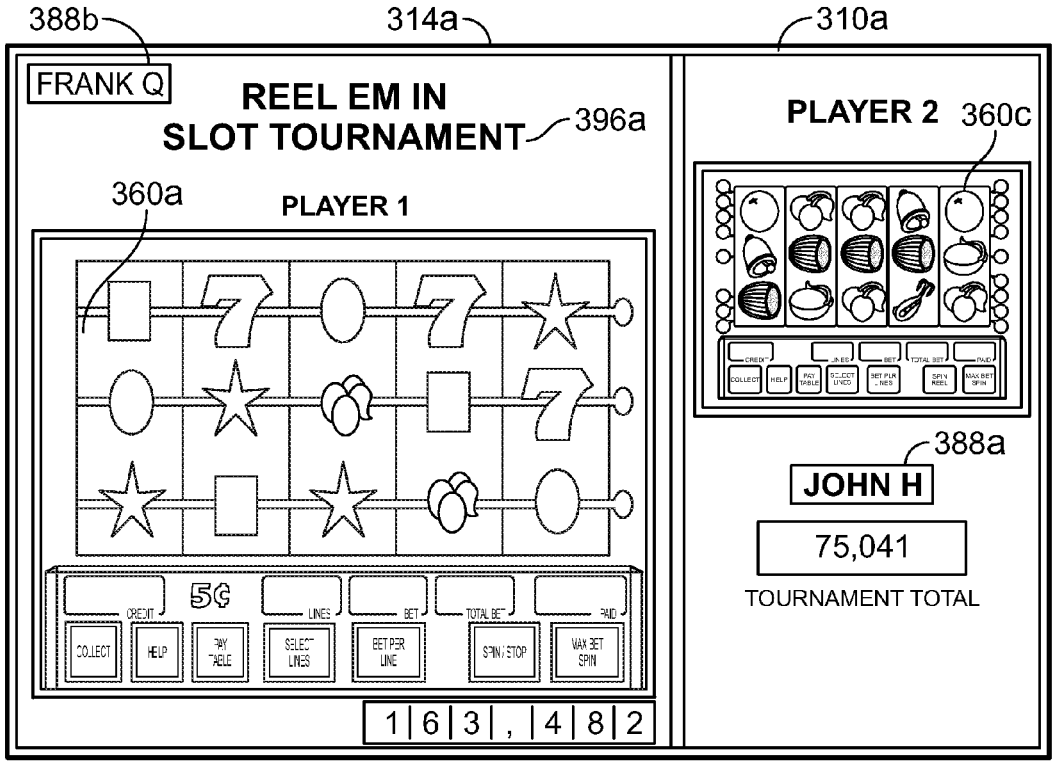
FIG. 8 is a screen shot of a second player's gaming device competing in a challenge-play game.

Turning to FIG. 8, the primary display 314*a* of the gaming device 310*a* played by the second player (Frank Q) is displayed, upon conclusion of the challenge-play game 396*a*. The upper left hand corner of the primary display 314*a* displays the player label 388*b* indicating "Frank Q" to demonstrate that player's participation in the primary wagering game 360*a* shown thereon. On the right hand side of the display 314*a* is a view of the first player's (John H) primary display 314*c* and primary wagering game 360*c*. Thus, as in FIG. 7 where the first player (John H) can view the progress of his competitor (Frank Q), here too, the second player (Frank Q) can view the play and progress of his competitor (John H) in the challenge-play game 396*a*. Each player's respective point total is shown beneath their respective primary wagering games 360*a,c*, such that the second player (Frank Q) can monitor both his own progress, and the first player's (John H) progress in the challenge-play game 396*a*. The primary display 314*a* further includes a player label 388*b* which indicates that the right hand side of the screen is dedicated to the first player's game 360*c*, by displaying the second player's identification as "John H," as well as that player's tournament total (or total accumulated points in the challenge-play game 396). As seen herein, the second player (Frank Q) has won the challenge-play game 396*a* by accumulating the most points. Thus, as seen in FIGS. 4-8, each player views and participates in the challenge-play game 396*a* from their own gaming device 310*a,c*, but is also able to see their competitor's progress via the picture-in-picture or split screen set up shown and described.

In addition to the individual displays of the challenge-play game 396*a* on the participants" gaming devices 310*a,c*, the challenge-play game 396*a* (or portions thereof) may also be displayed on other displays, such as the community display 380 in FIG. 3. The challenge-play game 396*a* continues until a conclusion is reached, which in this embodiment, is both players completing their designated number of spins. Upon conclusion, a winner is determined, in this case the player collecting the most points or credits in his set of free spins. The winner is given a prize and declared the victor in the challenge-play game 396*a*. The loser may also be awarded a prize.

In alternative embodiments, other configurations of challenge play may be utilized. For example, in an embodiment, players need not compete concurrently or simultaneously in a challenge-play game or event. One player may issue a challenge and complete his portion or "entry" in the challenge (for example, by conducting his free spins and posting a score or credit balance). The other player may receive the challenge at a later time, and accept or reject the challenge. If the other player accepts the challenge, he or she may then perform his portion or "entry" into the challenge-play game. For example, the second player may conduct his set of free spins and post a score or credit balance. At some later time, the system may evaluate the relative outcomes or scores of the participants in the challenge play event, determine and declare a winner, and award any associated prizes or awards. Moreover adjustments in the standings chart may be made accordingly.

In yet another embodiment, the challenge play event may involve more than two players. For example, the challenge play event may involve a competition amongst a plurality of players, each individually competing against the others (for example, a foot race). Moreover, the plurality of players may be subdivided into a plurality of teams which compete against one another in the challenge-play game. Players on a team may work cooperatively by taking turns, or pooling assets, results, points, or credits to achieve a team result. The various team results could then be compared to determine results of the challenge-play game. Other configurations are possible.

The content of the challenge-play game can be a large variety of game play functions and modalities. For example, the challenge play can be a board game, a sports competitions, a race, a contest, or any other game. Players can be represented in the challenge-play game by player identifiers, game pieces, player name, or an avatar or character could represent the players. Moreover, players may be given opportunities to customize their characters, avatars, or other representations by adding to, changing, or deleting assets, attributes, or skill components. The game play in the challenge-play game may be randomly determined, may be predetermined or scripted, or may be based upon skill, dexterity or prowess of the competitors. Moreover, game play in the challenge-play game may be based upon combinations of these inputs, such as random in part, and in part based upon player skill.

The challenge-play games may be accompanied by rule sets, eligibility requirements, and governing rules. For example, players may only be able to participate in (issue and accept) certain types of challenges, based upon a player's skill level, point level, membership level, etc. Outcomes of primary wagering games may be used to randomly determine eligibility for and participation in challenge play events. Certain restrictions, boundaries, and time requirements may be associated with certain challenge play events. For example, a challenge for a slot tournament to a player wherein the players need not participate simultaneously may be accompanied with a time requirement for entry. In one embodiment, when a player accepts a challenge to such a game, he is given three (3) days in which to complete a round of slot plays and post a score, credit balance, or entry into the challenge-play game. In other embodiments, other rule sets, criteria, or guidelines may be affixed to or associated with the challenge-play game. In an embodiment, the rule sets, eligibility requirements, and other guidelines are administered by an operator control computer in communication with the gaming devices and community displays of the system, over a wired or wireless network. Other rules in the rule set(s) may be directed at avoiding cheating or collusion. For example, a player may be only permitted to issue a challenge to a player who is locatable at a game device sufficiently far away from the issuing player so that the participants cannot see each others' displays, primary wagering games, or results. In this way, collusion can be minimized, using these and other rules.

In other embodiments, the ladder system of the standing chart may be utilized to foster additional competition amongst the players. For example, in the "King of the Hill" slot tournament of FIG. 3, players may be given a bonus award or extra award for climbing up the ladder a certain number of rankings, or for defeating and dethroning the first ranked player (knocking off the "King of the Hill"). In other embodiments, other incentives may be tied to the ladder system of the standing chart. For example, a player moving up a predetermined number of spots may be awarded an extra prize, award, or game play of another wagering game. Moreover, certain penalization techniques may also be applied to losers of challenge play events. A player who loses a challenge may be prohibited from participating in a challenge for a predetermined amount of time, or may be demoted a greater number of ranking in the standings chart for each subsequent loss.

In yet other embodiments, challenge-play games may include customization awards. For example, a player participating in or winning a challenge play may be provide intangible awards, such as the ability to replace symbols on his primary wagering game with customized symbols. The player may be permitted to select from screen backgrounds, customized sets of symbols, themes, etc. Moreover, the player may be allowed to upload a digital picture of himself, his family, his friends, his pet(s), etc. and use those pictures as symbols or elements in the primary wagering game, a challenge play event, or otherwise. Moreover, the player may be awarded a special symbol, payline, area, quadrant, or sector of a game field or board in which challenge play events occur. Thus, the player is permitted to passively participate in such events, without his presence required. For example, if a player is awarded a space on a board game, such as a Monopoly™ board, then even after the player leaves the casino, when other players participating in challenge play events land on that space on the board, the occupying player is given awards which are credited to his or her player account. The winning player can then learn about the awards he collected in his absence upon his return to the casino, by logging into a gaming device, or even remotely on his cellular phone or over the Internet.

Funding of challenge-play games may be accomplished in a number of ways as well. In an embodiment, players issuing and accepting invitations or challenges in a challenge play event may be required to place a side wager, or post an ante or entry fee of currency, credits, or other assets. The winner of the challenge may be awarded the losing player's ante or entry fee. Alternatively, the antes and entry fees may be collected and pooled into one or more pools and then distributed in accordance with one or more distribution rule sets which assign award values to particular results in the challenge-play games and events. In yet other embodiments, intangible prize awards in challenge play events may not require any entry fee or ante from the players and may be provided by a casino or operator as a incentivizing device or for entertainment. In yet other embodiments, the challenge play can be funded by player points, for example, frequent player points collected as part of a loyalty or reward program which tracks player game play and awards players therefore. Moreover, the funding for challenge play can come from surrender of assets or attributes collected during game play, such as player character assets, points, avatar attributes, skill levels, episodes completed, etc.

In some embodiments, the challenge-play game may be in addition to or supplemental to a primary wagering game, such as those shown in the FIGURES. However, in alternative embodiments, the challenge-play game may be the primary wagering game event. Players may play side games and make side wagers thereon in an effort to collect entries, assets, plays, points, or other inputs into the challenge-play game. Moreover, the primary wagering games may display randomly selected outcomes which form the entries in the challenge-play game. For example, a randomly selected outcome of the primary wagering game may include a set of instructions as to how a character is to move or otherwise act within a game field, board game, or playing field on which the challenge play event occurs. The symbols of the primary wagering game, for example, may indicate a direction and a number of spots to move, and the player's avatar or character on the playing field is moved in accordance with such an outcome. In so moving and acting the player's avatar or character may collect points, credits, awards, or other assets or attributes as it navigates and interacts with the playing field.

In another alternative embodiment, one or more "virtual trophies" may be used to stimulate game play and competition. For example, a virtual trophy may be provided to a player for receiving or accomplishing certain tasks or achievements during game play. In one embodiment, separate virtual trophies are created for achievements such as largest jackpot, most games played, most assets collected, most points earned, collection of certain symbols, advancement to highest episodes or stages, etc. The virtual trophies may be awarded for various achievements both inside of a casino or gaming environment, or remote therefrom, for example via game play on the internet, or a mobile device. In one embodiment, player's participation and collaboration on internet websites is a metric for which one or more trophies are awarded. The virtual trophies may be "travelling" trophies in the sense that when a person's achievement is surpassed by another player, the virtual trophy is passed from the first player to the second player. In one embodiment, the players' game play and accumulation of achievements is monitored via their player accounts, stored on a gaming system. The second player "winning" the trophy by overtaking the achievement of the first player possessing the trophy is notified of his receiving the virtual trophy while the first player "losing" the trophy is notified of his loss of the trophy. The first player may also be encouraged to return or continue game play in an effort to re-take the trophy. The encouragement may include audio and video displays, as well as incentives for game play.

Moreover, the gaming system operator (casino) as well as gaming device manufacturers may maintain internet websites to monitor, track, post results, and encourage game play through advertisement of the virtual trophies. The available trophies may be advertised along with the current possessor of the trophy and the current achievement necessary to overtake the possessor and gain the trophy. Moreover, players may be permitted to create their own personal websites (either linked to the casino and manufacturer sites, or remote therefrom) in which they can showcase their personal gaming achievements, including, for example, possession of certain trophies, achievements associated therewith, time of possession of trophies, etc. In one embodiment, players may maintain "virtual trophy cases" in which to show off and promote their current and past trophy winnings. Such trophy cases may be visible via websites, as well as via gaming devices, mobile devices, or other displays within a casino environment. In one embodiment, websites permitting wagering game play thereon may generate embeddable web objects which represent various players and their accomplishments or trophies. Such embeddable web objects may "follow" player icons, screen names, identifiers, or other representations to non-gaming websites and be inserted therein. This fosters and promotes play of the wagering game, by advertising player's gaming activities on non-gaming websites, such as social networking websites, for example.

The awarding, overtaking, loss of, transfer, and creation of virtual trophies may be advertised to players in any number of manners. Such events may be advertised, displayed or announced (visually and/or with audio) on individual gaming devices within a casino, including freestanding gaming devices and handheld devices. The events related to the virtual trophies may further be announced on personal mobile devices, casino signage located throughout a casino property, community displays, etc. For example, when a player possessing a trophy commences play at a gaming device (and the gaming device, via the player account on the system identifies the player), that player's possession of a certain trophy may be advertised by one or more displays or other signage on the gaming device, so as to promote to others in the casino that the player is a trophy holder. Moreover, the announcements may be made on internet websites as described above. By updated, displaying, and advertising these events, interest is generated in the competition for and receipt of the trophies. Players may be motivated by the "bragging rights" attendant to owning the trophy and being the "best" or having the highest associated achievement.

Moreover, player accounts on the system may permit players to create and maintain friends, contacts, associates, or "buddy lists" of other players. This may include their friends, family, relatives, etc. Through the system, players earning sufficient achievements to receive one or more virtual trophies may be permitted to notify persons on their contact or buddy lists of their accomplishment, furthering their ability to exercise "bragging rights" associated with the accomplishment. Messages may be broadcast to such persons (or any subsets thereof) via the system, which relate to and announce events associated with the creation, winning, loss, etc. of the virtual trophies. Gaming operators and/or manufacturers operating such systems may be provided with great flexibility to manage the virtual trophies via the gaming system and remote websites. For example, many forms of eligibility criteria may be imposed and controlled via one or more rule sets created and managed by gaming operators or manufacturers via the system or internet sites.

The systems, devices and methods described herein offer a number of benefits and advantages over traditional gaming systems. The challenge-play games offered by the present invention provide additional opportunities to increase enjoyment, excitement and anticipation for players, while simultaneously improving revenues for casinos and operators. By capitalizing on the inherent competitiveness of players, the systems allow players to issue and accept challenges to other plays to compete in a variety of challenge-play games or events. Winners of such events are awarded, and all players may be recognized by various standings charts, ladder systems, or other devices. Challenge play provides the added bonus of "bragging rights" in addition to awards, prizes, currency, or entry into other game play. Thus, by allowing players to compete against one another, casino operators provide wagering games which entice additional and repeat play, thereby generating additional revenue. Other benefits are provided as well.

Each of these embodiments and obvious variations thereof is contemplated as falling within the spirit and scope of the claimed invention, which is set forth in the following claims.

What is claimed is:

1. A gaming system comprising:

a plurality of wagering game machines, each wagering game machine comprising a wager input device for receiving wagers; and a controller operative to conduct a community game and to develop a standings chart tracking the standing of each player in the community game relative to other players in the community game and further operative to:

detect, during the community game, an issuance of a challenge by a first player having a first standing on the standings chart of the community game against a specific selected second player having a second standing on the standings chart of the community game, and an acceptance of the challenge by the second player to participate in the challenge-play game within the community game, the first standing and the second standing reflecting respectively a first player's accumulated points in the community game and a second player's accumulated points in the community game;

detect receipt of a funding input from at least one of the first player or the second player to enable the challenge-play game within the community game;

initiate the challenge-play game between the first player and the second player within the community game by separately displaying on a display of a first player's first wagering game machine both the first player's challenge-play game and the second player's challenge-play game and separately displaying on a display of a second player's second wagering game machine both the first player's challenge-play game and the second player's challenge-play game, so that progress of each player in their respective challenge-play game is displayed to the other player;

determine at least one outcome of the challenge-play game;

determine a winner of the challenge-play game, between the first player and the second player, based on the at least one outcome of the challenge-play game;

award at least a number of points to the winner of the challenge-play game, adding the number of points to the winner's accumulated community game points;

adjust the positions of the first player and the second player in the standings chart of the community game consistent with the first player's accumulated points and the second player's accumulated points at a conclusion of the challenge-play game.

2. The system of claim 1, wherein the challenge-play game comprises a slot tournament including one or more spins of one or more reels.

3. The system of claim 1, further comprising a community display viewable by one or both of the first and second players, the community display being configured to display the challenge-play game conducted by the first player and the second player.

4. The system of claim 1, wherein the challenge-play game consists of only the first player and the second player.

5. The system of claim 1, wherein one or more outcomes of a first primary wagering game conducted on the first wagering game machine qualify the first player to participate in the challenge-play game.

6. The system of claim 5, wherein one or more outcomes of the second primary wagering game conducted on the second wagering game machine qualify the second player to participate in the challenge-play game.

7. The system of claim 1, wherein the controller is further operative to declare either the first player or the second player a winning player, and provide, further to the number of points to the winner of the challenge-play game, a first award to the winner of the challenge-play game separate from any award related to the community game in which the challenge-play game is conducted.

8. The system of claim 1, wherein the challenge-play game is not a skill-based game.

9. A wagering game system comprising:

a first gaming device configured to conduct a first primary wagering game in response to wager input by a first player and configured to conduct a community game, the first player having a first standing in a community game, the first standing reflecting a first player's accumulated points in the community game;

a second gaming device configured to conduct a second primary wagering game in response to a wager input by a second player and configured to conduct the community game, the second player having a second standing in the community game, the second standing reflecting a second player's accumulated points in the community game;

a first input device in communication with the first gaming device for receiving a challenge-play input from the first player, the challenge-play input comprising a locator input configured to locate a competitor and issue a challenge-play invitation to the competitor during the community game; and a second input device in communication with the second gaming device for receiving a response input from the second player, the response input accepting, rejecting, or modifying the challenge-play invitation issued during the community game;

at least one display for displaying a selected challenge-play game in response to acceptance of the challenge-play invitation by the second player during the community game, the at least one display being configured to simultaneously and separately show one or more randomly determined outcomes in the first player's challenge-play game and one or more corresponding randomly determined outcomes in the second player's challenge-play game; and a controller configured to determine a winner of the challenge-play game based on the respective one or more randomly determined outcomes, award at least a number of points in the challenge-play game at least to the winner of the challenge-play game, add the awarded number of points to an accumulated number of points in the community game for the winner of the challenge-play game, adjust the positions of the first player and the second player in the standings chart of the community game consistent with the first player's accumulated community game points and the second player's accumulated community game points at a conclusion of the challenge-play game.

10. The system of claim 9, wherein the challenge-play input further comprises a selection of a challenge-play game from a plurality of available challenge-play games, the plurality of available challenge-play games including the selected challenge-play game.

11. The system of claim 9, further comprising at least one controller for determining eligibility of the first and second players to participate in the selected challenge-play game.

12. The system of claim 9, wherein the at least one display comprises a first display coupled to the first gaming device and a second display coupled to the second gaming device.

13. The system of claim 9, wherein the challenge-play game is not a skill-based game.

14. The system of claim 9, wherein the challenge-play game consists of only the first player and the second player.

15. A method of operating a wagering game comprising:

displaying, on a display device of a first wagering game machine, a first primary wagering game to a first player in response to receipt of a first primary wager, the first player having accumulated community game points conveying a first standing on a standings chart of a community game;

displaying, on a display device of a second wagering game machine, a second primary wagering game to a second player in response to receipt of a second primary wager, the second player having accumulated community game points conveying a second standing on the standings chart of the community game;

detecting, during a community game in which the first player and the second player are participating, an issuance of a challenge-play invitation by the first player and an acceptance of the challenge-play invitation by the second player, the challenge-play invitation comprising a challenge-play game selected from a set of available challenge-play games;

determining eligibility of the first player and second player to participate in the challenge-play game;

collecting challenge-play funds for funding the challenge-play game;

during the community game, displaying the challenge-play game on one or more of the first wagering game machine, the display of the second wagering game machine, or another display;

determining a winner of the challenge-play game;

awarding at least a number of challenge-play game points at least to the winner of the challenge-play game;

adding the awarded number of challenge-play game points awarded to the accumulated community game points of the winner of the challenge-play game; and adjusting the positions of the first player and the second player in the standings chart of the community game consistent with the first player's accumulated community game points and the second player's accumulated community game points at a conclusion of the challenge-play game.

16. The method of claim 15, wherein the challenge-play funds comprise a first side wager from the first player.

17. The method of claim 16, wherein the challenge-play funds comprise a second side wager from the second player.

18. The method of claim 15, wherein the challenge-play funds comprise player award points accumulated by one or both of the first and second players.

19. The method of claim 15, wherein the challenge-play funds comprise redemption of one or more assets or attributes collected by one or both of the first and second players.

20. The method of claim 15, wherein the challenge-play funds are received from a challenge play pool and distributed in accordance with a distribution rule set, wherein the challenge play pool is funded by at least one side wager received from one or both of the first and second players.

* * * * *

UNITED STATES PATENT AND TRADEMARK OFFICE

CERTIFICATE OF CORRECTION

PATENT NO. : 8,568,222 B2
APPLICATION NO. : 12/738595
DATED : October 29, 2013
INVENTOR(S) : Gagner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 391 days.

Signed and Sealed this
Fifteenth Day of September, 2015

Michelle K. Lee

Michelle K. Lee
*Director of the United States Patent and Trademark Office*